US005769271A

United States Patent [19]

Miller

[11] Patent Number: 5,769,271

[45] Date of Patent: Jun. 23, 1998

[54] APPARATUS AND METHODS FOR MONITORING A BEVERAGE DISPENSER, IN PARTICULAR A COUNTER SYSTEM

[75] Inventor: Hans-Peter Miller, Surheim, Germany

[73] Assignee: Wilhelm Handke GmbH, Freilassing, Germany

[21] Appl. No.: 586,887

[22] PCT Filed: Aug. 11, 1994

[86] PCT No.: PCT/EP94/02690

§ 371 Date: Jan. 24, 1996

§ 102(e) Date: Jan. 24, 1996

[87] PCT Pub. No.: WO95/05337

PCT Pub. Date: Feb. 23, 1995

[30] Foreign Application Priority Data

Aug. 15, 1993 [DE] Germany ..... 43 27 337.8

[51] Int. Cl.[6] ..... B67D 5/10

[52] U.S. Cl. ..... 222/1; 222/2; 222/63; 222/504; 222/641

[58] Field of Search ..... 222/1, 2, 30, 36, 222/23, 641, 63, 504

[56] References Cited

U.S. PATENT DOCUMENTS

| | | | |
|---|---|---|---|
| 3,257,033 | 6/1966 | Stott | 222/504 X |
| 3,307,743 | 3/1967 | Wagner et al. | 222/1 |
| 3,464,591 | 9/1969 | Nicola | 222/30 |
| 3,467,279 | 9/1969 | Upton et al. | 222/641 X |
| 3,685,692 | 8/1972 | Erne et al. | 222/23 |
| 4,225,057 | 9/1980 | Horn | 222/26 X |
| 4,421,248 | 12/1983 | Porcina | 222/25 |
| 5,133,480 | 7/1992 | Matsumoto et al. | 222/2 |
| 5,255,819 | 10/1993 | Peckels | 222/30 X |

FOREIGN PATENT DOCUMENTS

| | | | |
|---|---|---|---|
| 0442375 | 2/1991 | European Pat. Off. . | |
| 2453743 | 5/1976 | Germany . | |
| 3329799 | 3/1985 | Germany . | |
| 403212 | 8/1991 | Germany . | |
| 9312615.8 | 2/1994 | Germany . | |
| 9316028.3 | 3/1994 | Germany . | |
| 4327337 | 7/1994 | Germany . | |
| 4307415 | 9/1994 | Germany . | |
| 4317946 | 12/1994 | Germany . | |
| 2116763 | 9/1983 | United Kingdom . | |
| 2244698 | 12/1991 | United Kingdom | 222/36 |

*Primary Examiner*—Kevin P. Shaver
*Attorney, Agent, or Firm*—Nixon & Vanderhye

[57] ABSTRACT

In a drink-dispensing installation, an authorized individual is required to identify himself by entering a code into a code-registering station. The drinks-dispensing installation includes an automatic valve and a manually-actuable hand-dispensing valve connected in series with the automatic valve. The automatic valve is maintained in an open position and is closed at a time subsequent to the start of opening the hand valve when a drink is first drawn off from the dispensing installation without first entering the code.

15 Claims, 2 Drawing Sheets

Figure 1:
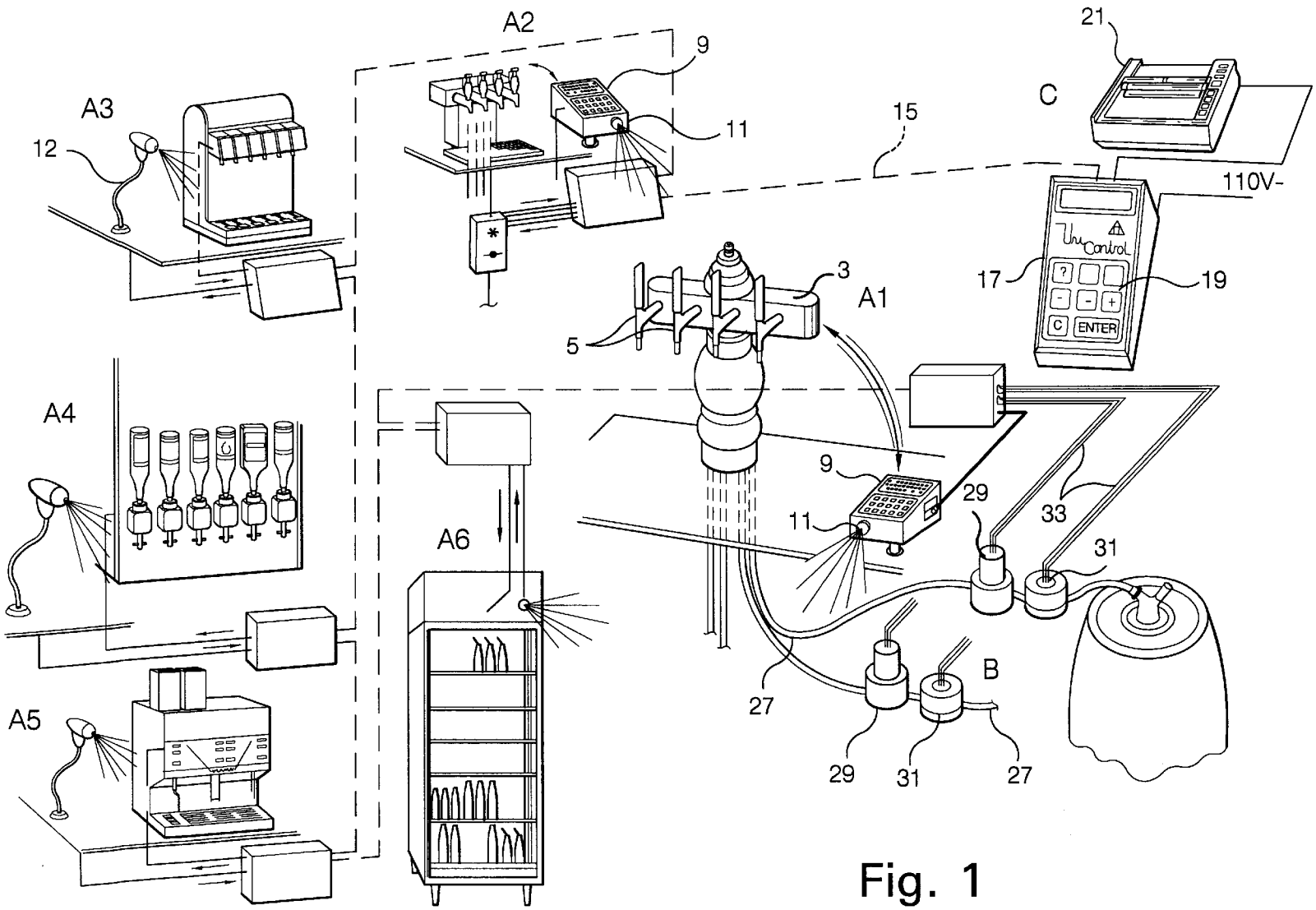

APPARATUS AND METHODS FOR MONITORING A BEVERAGE DISPENSER, IN PARTICULAR A COUNTER SYSTEM

The invention relates to a method of, and to an apparatus for, monitoring a drinks dispenser, in particular in the form of a draught-dispensing installation.

A method of a generic type, and an associated apparatus, for monitoring the drinks dispenser in bars or the like has been disclosed, for example, by EP 0 442 375 A1. As is customary, an authorized individual has to identify himself by a code when drawing off a drink. In order that the drink types and quantities dispensed are assigned to the correct code without the draught-dispensing operation being obstructed, it has been proposed that the drinks dispenser is permanently kept open, an alarm signal being emitted when a drink is drawn off without a code being entered, and that the alarm signal is terminated only when identification has been carried out. The liquid which has been removed is then assigned to the code used for turning off the alarm.

Nevertheless, a method of this type has disadvantages. The situation where an authorized individual completes a drawing-off operation and leaves the drinks-dispensing station without having entered his code cannot be ruled out. If there is to be no interruption to the further drawing-off operation, then another authorized individual would then have to enter his code, in order to stop the emitted alarm signal, and draw off the drinks and/or drinks required by him. In this case, however, the preceding drawing-off operation, which may have been carried out by another authorized individual, would be assigned to the succeeding authorized individual, as regards the number of drinks drawn off and the selected drinks, and his code would be debited accordingly.

In the Patent Applications P 43 07 415.4-23 and P 43 17 946.0-23, there is proposed another method. In order to avoid the drawn-off quantity being assigned incorrectly to a certain code, it is provided that, after a presettable metered quantity has been reached, the metering operation is automatically terminated by closure of the automatic valve, which is connected in series with the hand valve. In conjunction with the preset electronics, this also provides the advantage that optionally as often as required or, in accordance with the proposal of P 43 17 946.0-23, only in the case of a permissible subsequent interrogation, a corresponding interruption can be carried out and then, nevertheless, the drawing-off operation can be terminated completely. The automatic valve preferably opens only once the staff identification has been entered, in order that an unambiguous assignment is achieved.

Although the last-mentioned draught-dispensing installations have proved favorable as far as their functioning is concerned, there may, in some circumstances, be a problem with certain drinks, for example with beer, that, once the automatic valve has been closed, the subsequent line section between the automatic valve and the hand valve is not under pressure, and this may result in a certain decarbonization, i.e. foaming, of the drink, which may not always be desired.

The object of the present invention is thus to provide a further improved method and an improved draught-dispensing installation, in which, in particular, decarbonization remains restricted only to those cases of actual incorrect operation when a drink is drawn off without a code being entered beforehand.

The invention makes it possible to remove completely the incentive for improper usage. Even if staff attempt, for example, to draw off the drink in small portions without identification (and thus without billing), this lasts over a relatively long period of time, so that it is questionable as to whether the drink can still be sold at all. In addition, the individual trying to use the installation improperly has to put up with the secondary effect of a loud signal, which constantly draws attention to the incorrect behavior.

The quantities which can be drawn off without waiter identification are basically comparatively small and may additionally be registered in the billing, and thus monitored.

There is no possibility for improper usage during an identification phase since the various units are detected automatically.

The method permits the operation of a traditional, conventional draught-dispensing block, while maintaining long-standing tried and tested drawing-off practices, and thus ensures rapid and problem-free drinks dispensing, combined with the great advantages of virtually 100% monitoring and precise automatic billing.

The invention provides that, once the hand valve has been opened, that is to say once the drawing-off operation has begun, and, to be precise, if no code has been entered, the automatic valve does not close immediately, but closes at a point offset in time. That is to say, a certain, small, but altogether barely significant leakage quantity, which cannot be assigned to a code, is dispensed.

Should the drawing-off operation be started without a code being entered beforehand, then, of course, an acoustic and/or visual signal may simultaneously be produced in addition.

An authorized individual realizes, inter alia by the flow of drinks which peters out immediately, that the code has not been entered, and can close the hand valve again immediately thereafter. If the hand valve is closed at least before the final closure of the automatic valve or in this period, then the automatic valve can open again immediately in order to keep the line to the hand valve under pressure. Consequently, the carbonization, i.e. foaming of the drinks and, in particular, of the beer is always reliably avoided.

The case in which no code has been entered and, despite the recognizable petering-out of the flow of drinks, the hand valve is left in the open state, thus resulting in the automatic valve then actually closing, may actually be described as a genuine case of incorrect operation, which only occurs on a very small number of occasions. However, even if the hand valve is closed again thereafter and a code is entered, the drawing-off operation can be carried out normally again immediately by the hand valve being opened, the automatic valve opening again immediately in this case. The thus remaining short period in which the automatic valve was actually closed is not sufficient for undesirable decarbonization of the drink to take place in the line between the automatic valve and the hand valve.

In a preferred embodiment of the invention, the automatic valve closes slowly and continuously in the event of an attempt at drinks dispensing without a code being entered beforehand. In addition to this, or alternatively thereto, the closure operation for the automatic valve may also take place in a stepped manner. The closure time, i.e. the termination of the complete closure operation of the automatic valve may be offset by a unit of time of at least 0.5 sec with respect to the point in time at which the hand valve is opened. The time range of 0.5 sec to 2 sec may be sufficient.

According to the invention, it is preferred that the small quantity of drinks dispensed in this case of incorrect operation is not assigned to the subsequent drinks-dispensing operation when the code is entered. However, the small quantities of drinks dispensed, in the event of the above-described incorrect operation, until the automatic valve is closed may then be assigned, by the associated evaluation electronics, to an "incorrect operation" account. Consequently, the operator of the draught-dispensing installation or the bar owner, etc. can read off the frequency and extent of such incorrect operations.

The method according to the invention preferably also provides, inter alia, that the draught-dispensing installation is constantly checked, in a processor-aided manner, for operational and system faults and it is only when a deviation from normal operation is established that first of all a clear signal is produced and - if the deviation is not eliminated, or cannot be eliminated, as quickly as possible - the automatic valve closes. Resetting of the signal and of the valve is then only possible via an authorization identification. During the drinks dispensing, an automatic proportion-detection system ensures rapid and reliable detection of the drinks units as a basis for highly accurate automatic billing.

Figure 2:
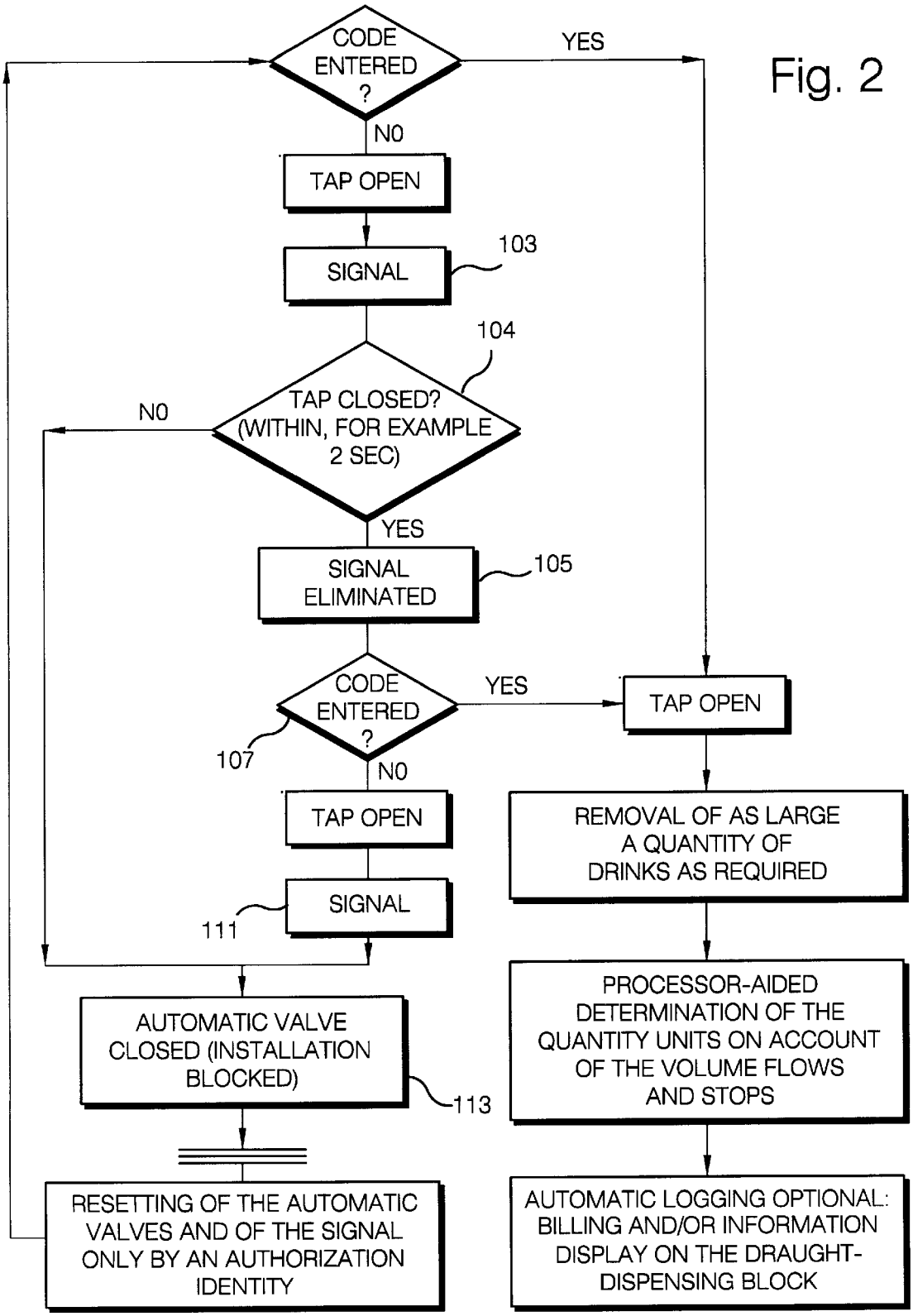

Further advantages, details and features of the invention are given hereinbelow in the exemplary embodiment represented with the aid of drawings, in which, in detail:

FIG. 1: shows a schematic perspective representation of an automated draught-dispensing installation according to the invention; and FIG. 2: shows a flow chart for illustrating the basic principle of the method according to the invention.

FIG. 1 illustrates the basic construction, in a schematic perspective representation, of an automated draught-dispensing installation according to the invention, the basic construction of which corresponds in principle to that disclosed in Patent Application 43 07 415.4-23 and/or Patent Application P 43 17 946.0-23.

The draught-dispensing installation according to FIG. 1 comprises a number of bar or dispensing areas A1 to A6, a refrigeration area B and the office, computer and evaluation area C.

The bar region A1 is, for example, a draught-dispensing bar which is conventional in principle and has draught-dispensing blocks 3 and taps or hand valves 5 provided thereon.

A metered-quantity selection switch 9 may further be provided. The code identification takes place via a so-called waiter-recognition or staff reader unit 11.

The exemplary embodiments A2 to A4 comprise the envisaged waiter-recognition apparatuses 11, for example spaced apart from the actual drinks-dispensing station, which apparatuses may be accommodated in a housing seated on a flexible swan neck 12. The signals received are passed on, via a line or line bus 15 (via a corresponding ring line 15 in the exemplary embodiment shown) to control/evaluation electronics 17 in the office area C.

The control and evaluation electronics 17 preferably operate on the basis of a microprocessor or PC, by means of which, via corresponding input and operator consoles 19 and an output unit 21, corresponding entries necessary for the overall operation of the installation can be input or corresponding data can be output.

For example a number of drinks containers 25, inter alia for dispensing beer, may be provided from a refrigeration area B, which drinks containers lead to the taps or hand valves 5 via corresponding lines 27.

As regards the draught-dispensing installation A1, it is shown that an automatic valve 29 and a throughflow measuring sensor 31 are connected in series at a suitable location in each line 27. Irrespective of the order with respect to the throughflow measuring sensor 31, the automatic valve 29 is preferably accommodated such that it is spaced apart from the hand valve or taps 5. The automatic valves 29 and the throughflow measuring sensors 31 are likewise connected, via corresponding lines and line buses 33, to the computer-aided control and evaluation electronics 17.

The further drinks-dispensing stations or drawing-off stations A2 to A5 represented in FIG. 1 relate, for example, to an externally metering draught-dispensing block, for which purpose a corresponding selection keypad 9 is switched in for entering the drinks quantity and/or the specific drink.

In this exemplary embodiment according to A2, the staff-identification-code register 11 is also assigned to the selection keypad 9. Each waiter, for example, may have stored in a watch-like housing a personal identification code, which emits the corresponding signals and is registered and processed accordingly upon being guided past the code-registering apparatus 11.

The drinks-dispensing station A3 relates to a draught-dispensing block with internal metering, by means of which, in the end, the overall quantity is automatically determined by way of the drawn-off quantity (via a corresponding throughflow measuring sensor 31) and is passed on to the evaluation electronics 17.

The drinks-dispensing station A4 relates to a schnapps-metering device which can also operate in the manner of the drinks-apportioning device (if appropriate also without a throughflow motoring sensor 31).

As far as the drinks-dispensing stations A5 and A6 are concerned, it is only schematically shown that further drinks-dispensing stations for example in the form of a coffee or tea machine or of a drinks cabinet are also integrated in the overall installation and managed and controlled together with the same.

The mode of operation of the above draught-dispensing installation will now be described with reference to FIG. 2.

Basically, the respectively mentioned automatic valve 29 assigned to the individual tap is open during the entire operation of the draught-dispensing installation. As is also the case for each conventional draught-dispensing installation, the dispensing of the drinks is begun by the tap or hand valve 5 being opened and, finally, is terminated once the desired quantity has been reached. For this purpose, the tap, i.e. the hand valve 5, is closed again. During this, the automatic valve 29 remains open. It can already been seen that, as in the case of every conventional draught-dispensing installation, the drawing-off operation can be interrupted once or, if appropriate, a number of times—if no other authorization requests are present and electronic connection has taken place and/or corresponding monitoring is provided.

Basically, the waiter identification is required before drinks are removed. It is only when this identification is given that a drawing-off operation can be successfully carried out and terminated.

In this case, preferably as many drinks quantities and/or different drinks as required can be drawn off, these being assigned to the respectively entered code.

In this arrangement, the quantity drawn off can be registered by the throughflow measuring sensor 31 and assigned to the entered code. However, the quantity drawn off may also be determined in accordance with specific steps and portions and then assigned to the code. If, as example, a preset quantity of 0.25 l is exceeded or after exceeding a small, still-permissible excess metered quantity up to, for example, 0.26 l, then it is automatically assumed, in a processor-aided manner, that the next permissible quantity of, for example, 0.5 l, (in the case of beer), is to be dispensed next. Even in the event of a final interruption to the drawing-off operation and removal of the waiter code, this portion size would then automatically be assigned to the previously applicable waiter code.

By virtue of this processor-aided analysis of the quantity-related and time-related volume flows by way of a comparison with previously entered drinks-specific drawing-off characteristics, different portion sizes are also detected automatically without it being necessary to select a portion via a keyboard beforehand.

A display may be provided beside the draught-dispensing block 3, which display, during normal operation, shows information as to the drinks registered under the last code. In addition, malfunction indications, fault indications and information as to which quantities the barrel 25 may (still approximately) contain and as to whether a barrel or drinks container is then actually completely emptied may be displayed.

In addition, the display may also be used to show the billing and/or the total of the drinks quantities dispensed and of the types of drinks dispensed.

A keypad 9 may be provided beside the draught-dispensing block 3 in order for it to be possible to enter special drinks or mixed drinks which are not registered automatically. In addition, after authorization identification has taken place, it may be possible to delete or change the last-registered drinks via the keypad e.g., as a result of an operational fault, the quantities registered do not correspond with the quantities removed.

If, however, an attempt at drinks removal is inadvertently made without waiter identification, then a signal 103 which cannot fail to be heard and/or seen is preferably produced first of all. It is thus indicated to the operator that the tap 5 should be closed again immediately because the waiter identification has not been entered. If, after this, the tap 5 is closed again within a preset time $t_{wait}$ (interrogation 104 in FIG. 2), then the emitted signal is turned off again at 105.

Thereafter, by subsequently making good the entry of the waiter identification at 107 (in FIG. 2), the drawing-off operation can be carried out as normal. That is to say, once the tap 5 has been opened, as many drinks as required can be removed.

If, however, the signal is disregarded over more than, for example, 2 sec ($t_{wait}$) in that the tap 5 is not closed, improper usage is assumed and the automatic valve 31 of the relevant line 27 or all the automatic valves 29 of the relevant draught-dispensing block 3 are closed.

The closure operation takes place at a point offset in time with respect to the start of opening of the hand valve 5. That is to say, in such a case, the automatic valve 29 closes only after a bridging time $t_{wait}$ of usually more than 2 sec up to approximately 2.5 or 3 sec. When the hand valve 5 is opened (with no waiter identification), the closure operation can close in a stepped or continuous manner or after a bridging time of, for example, approximately 2 sec, can then close abruptly or likewise in a stepped or continuous manner until an overall time of, for example, 2.5 sec or 3 sec is reached. In each case, the operator immediately recognizes, by the drinks flow immediately petering out (and in the event of the acoustic and/or visual signal 103 being produced in addition), that the waiter identification has not been entered (the acoustic and/or visual signal 103 is advantageous here, but not absolutely necessary).

In other words, once the hand valve 5 has been opened, the final closed position of the automatic valve 29 should be reached at a point offset in time, such that the entire closure phase, as calculated from the start of opening of the hand valve 5, takes longer than at least 0.5 sec, preferably 0.75 sec or 1 sec. Preferred values lie, in each case, above 1.25 sec, 1.5 sec, 1.75 sec or even 2 sec, as outlined above.

The conventional mode of operation is thus such that, if there is no waiter identification and the hand valve 5 has been opened, basically the automatic valve 29 is closed completely, after a preset time of $t_{wait}$ has been reached, if the hand valve 5 is not moved into the closed position within this time. In this case, the further closure operation of the automatic valve 29 is stopped immediately and the automatic valve 29 can change over into its completely open position again. This can be detected by the throughflow measuring sensor 31 and the corresponding position of the automatic valve 29, because, when the automatic valve 29 is not yet completely closed, if the throughflow measuring sensor 31 detects an interruption in the drinks quantity flowing through, this means that the tap, and thus the hand valve 5, must already be closed.

In this case too, there is thus reliable avoidance of the situation where the line 27 is depressurized in the section of said line between the automatic valve 29 and the hand valve or tap 5. Accordingly, decarbonization and frothing of certain drinks, for example beer, can be reliably avoided.

In the case described, only an extremely small drinks quantity is thus dispensed up to the point at which the automatic valve 29 is closed (if the hand valve 5 has not already been closed beforehand). Said small drinks quantity is preferably not assigned to the following staff identification in the event of a renewed drawing-off operation, but is allocated to a special account. As a result, it is thus possible to determine at a later date as to whether the abovementioned incorrect operations took place from time to time, only rarely or not at all.

If, following an inadvertent attempt at drinks removal without a waiter identification being entered beforehand, the tap 5 is indeed closed, but then a second attempt is made to remove drinks without waiter identification, improper usage is likewise assumed. According to the flow chart of FIG. 2, the signal is produced again at 111 and the associated automatic valve 29 is closed at 113 in the flow chart. Resetting of the automatic valve 29 and of the signal is then possible only if an authorization identification is entered. This is intended to prevent the situation where a number of small leakage quantities are added up one after the other.

The non-identified quantities and/or the number of non-identified removal attempts are registered in the course of the billing period. Upon exceeding a limit value which can be freely established (e.g. more than 5 incorrect operations in 10 minutes or more than 30 incorrect operations over a billing period or more than 0.5 liters of waste in 60 minutes), improper usage is then assumed once more and the automatic valves 29 are closed, a signal being produced in addition. Resetting of the automatic valves 29 and of the signal is then possible only via an authorization identification.

If, after interrogation at 104 in the flow chart, the tap 5 is not closed or is only closed once the preset time $t_{wait}$ has been exceeded and the associated automatic valve 29 is closed, resetting of the automatic valve 29 into the open state and turning off the signal take place only when an authorization identification is entered again.

Thereafter, normal drawing-off operation can be carried out again.

As may also be seen from the illustrated construction of the overall installation according to FIG. 1, the waiter-recognition apparatuses 11 are preferably arranged separately from the respective drinks-dispensing machine or draught-dispensing block 3. This means that there is no obstruction when entering the staff identification and dispensing the drinks. When a new waiter identification is entered, the previous one is deleted.

When using external metering devices (see 9), it is possible and preferable for not only the drinks, but also the drinks quantities to be preset. This gives advantages, in particular, also in the case of mixed drinks, for example cola/lemonade mixed drinks or so-called shandies.

Furthermore, provision may also be made for preventing the dispensing of drinks when system faults occur.

In this arrangement, the electronic unit 17 may be fitted with a fault-detection means which constantly checks its own functioning and that of the peripheral units and/or apparatuses. If a fault is detected, this gives rise to a fault indication (e.g. "turbine 12 defective", "automatic valve 02 is not closing", "leak in line 03", "electronics defective", etc.) and all the automatic valves 29 close, a signal being produced in addition. Resetting of the automatic valves 29 and of the signal is then possible only by an authorization identification.

Finally, it is also possible for unmonitored dispensing of drinks to be prevented in the event of a power failure.

For this purpose, it is provided that all the automatic valves 29 likewise close in the event of a power failure. Said valves can be opened again via an authorization-key switch in order to permit manual emergency operation (a power reserve in the form of a battery may, for example, make this operation possible).

I claim:

1. A method of monitoring a drinks dispenser in a drink-dispensing installation having an automatic valve and a manually actuable hand-dispensing valve connected in series with the automatic valve and requiring an authorized individual to identify himself by entering a code to dispense the drinks, comprising the steps of:

maintaining the automatic valve open, opening the hand valve and closing the automatic valve at a time subsequent to a start of the opening of the hand valve when a drink is drawn from the dispenser without first entering the code.

2. A method according to claim 1, including the step of commencing the closing of the automatic valve in response to opening the hand valve without a code having been entered and thereafter slowly closing the automatic valve.

3. A method according to claim 2, including continuously closing the automatic valve after its closure has been commenced.

4. A method according to claim 1, including closing the automatic valve in a stepped manner in response to opening the hand valve without a code having been entered.

5. A method according to claim 1, including maintaining the automatic valve completely or partially open for a bridging time and closing the automatic valve within a subsequent brief closure time of approximately 0.1 second to approximately 1 second.

6. A method according to claim 1, including emitting an acoustical or visual signal in response to opening the hand valve without a code being entered beforehand, and beginning closing the automatic valve once the visual signal has appeared or the acoustic signal has been sounded.

7. A method according to claim 1, including stopping the closing of the automatic valve and returning the automatic valve to its completely open position in response to closing the hand valve after the start of drawing off a drink without a code entry and before the final closed position of the automatic valve has been reached.

8. A method according to claim 1, including terminating the closure of the automatic valve after the hand valve has been opened without a code entry in a period of preferably 0.3 second to 3 seconds.

9. A method according to claim 1, including, in the event of an incorrect operation when the automatic valve has been finally closed and a code is subsequently entered, interrogating whether a prior removal attempt has been conducted without an entered code before the automatic valve is closed, and opening the automatic valve in response to the interrogation.

10. A method according to claim 1, including, subsequent to an attempt at drinks removal without a code being entered and closure of the hand valve within a pre-settable time, closing the automatic valve irrespective of the position of the hand valve in response to a subsequent second attempt at drinks dispensing without a code being entered.

11. A method according to claim 1, including closing said automatic valve in response to (a) exceeding a pre-settable number of incorrect operations within a unit of time, (b) exceeding a pre-settable limit value for a permissible number of incorrect operations during a billing period, or (c) upon exceeding a quantity limit value for a non-accountable quantity of drinks.

12. Apparatus for monitoring a drinks dispenser in a drink-dispensing installation, comprising:

a drinks-dispensing station;

a code-entering and registering station;

a drinks supply line having a normally open automatic valve, a throughflow sensor connected in series with said automatic valve and a hand-operated valve assigned to said drinks-dispensing station;

an electronic control unit;

said automatic valve and said throughflow sensor being connected to said control unit for closing said automatic valve in response to dispensing a drink at said dispensing station without a code being entered at said code-entering and registering station and at a time subsequent to opening the hand valve.

13. Apparatus according to claim 12, including means for closing the automatic valve over a period of time.

14. Apparatus according to claim 12, including means for continuously closing the automatic valve for a period of time.

15. Apparatus according to claim 12, including means for closing the automatic valve in a stepped manner.

* * * * *